US006503145B1

(12) United States Patent
Webb

(10) Patent No.: US 6,503,145 B1
(45) Date of Patent: Jan. 7, 2003

(54) CASINO GAME WITH MULTIPLE PLAYING MODES AND WAGERING OPTIONS

(75) Inventor: Derek J. Webb, Derby (GB)

(73) Assignee: Prime Table Games LLC, Las Vegas, NV (US)

( * ) Notice: Subject to any disclaimer, the term of this patent is extended or adjusted under 35 U.S.C. 154(b) by 77 days.

(21) Appl. No.: 09/589,202

(22) Filed: Jun. 8, 2000

(51) Int. Cl.[7] ..... A63F 13/00

(52) U.S. Cl. ..... 463/16; 463/12; 463/13; 273/292

(58) Field of Search ..... 463/11–13, 16–25, 463/29; 273/274, 292

(56) References Cited

U.S. PATENT DOCUMENTS 5,265,882 A * 11/1993 Malek ..... 273/274
5,328,189 A * 7/1994 Malek ..... 273/274
5,395,120 A * 3/1995 Malek ..... 273/292
5,407,199 A * 4/1995 Gumina ..... 273/139
5,494,296 A * 2/1996 Grassa ..... 273/274
5,531,448 A * 7/1996 Moody ..... 273/292
5,639,092 A * 6/1997 Macaisa ..... 273/274
5,653,444 A * 8/1997 Dahl ..... 273/274
5,678,821 A * 10/1997 Hedman ..... 273/274
5,839,732 A * 11/1998 Guidi ..... 273/292
5,868,392 A * 2/1999 Kraft ..... 273/292
5,868,618 A * 2/1999 Netley et al. ..... 463/13
5,897,436 A * 4/1999 Singer et al. ..... 273/293
5,901,958 A * 5/1999 Andrews ..... 273/292
5,988,643 A * 11/1999 Awada ..... 273/292
6,019,374 A * 2/2000 Breeding ..... 273/292
6,070,873 A * 6/2000 Perkins ..... 273/292
6,113,102 A * 9/2000 Marks et al. ..... 273/292
6,131,908 A * 10/2000 Palmer ..... 273/292
6,158,741 A * 12/2000 Koelling ..... 273/292
6,182,969 B1 * 2/2001 Green ..... 273/292
6,206,375 B1 * 3/2001 Wichinsky ..... 273/274
6,227,969 B1 * 5/2001 Yoseloff ..... 463/13
6,334,614 B1 * 1/2002 Breeding ..... 273/274

* cited by examiner

*Primary Examiner*—Michael O'Neill
*Assistant Examiner*—John M Hotaling, II
(74) *Attorney, Agent, or Firm*—Nixon & Vanderhye P.C.

(57) ABSTRACT

A casino game incorporates a first compulsory playing mode and one or more optional playing modes without a house advantage. Preferably, the first playing mode is a three-, five- or seven-card poker game against a payout scale based on the respective hand poker rank. Optional modes without a house advantage include head-to-head poker games against the dealer and poker games against other players. Side wager options are also available for high hands, thereby increasing player interest by providing a chance for a high payout.

32 Claims, 2 Drawing Sheets

CASINO GAME WITH MULTIPLE PLAYING MODES AND WAGERING OPTIONS

BACKGROUND OF THE INVENTION

The present invention relates to a casino game incorporating multiple playing modes and multiple wagering options and, more particularly, to a casino poker game that includes modes of play with no casino advantage.

Casino operators are continuously searching for ways to make casino table games more attractive and player friendly. New poker derivatives such as Caribbean Stud, Let-it-Ride, Pai Gow Poker, and Three Card Poker have made a significant contribution; however, many traditional players still regard these games as having too high a house advantage. Therefore, there would be a significant market for a poker derivative game where the house advantage was less apparent. Ideally, a beneficial innovation could include the implementation of a game incorporating bets with no house advantage.

With respect to types of poker, conventional established terms are draw and stud. These terms have become out-of-date as community card games and showdown games are established. Community card games such as Hold'em and Omaha could be regarded as combining aspects of both draw and stud, whereas showdown could be dealt as either a draw, stud or community card version.

Showdown is a version where equal bets by each player are made, and each player receives the appropriate poker hand for the variation played. The hands are shown and the best hand wins. Therefore, there is no skill at basic showdown. This version has been played as one-table satellite events for tournaments, whereby the total pool or pot of equal player bets or entry fees is sufficient to enable the winner to enter the relevant poker tournament.

There are of course a variety of forms of poker such as three-card, five-card and seven-card. These varieties could be played in each of the types described, being draw, stud, community card or showdown. Also, there are different play methodologies such as player hand against player hand, player hand against house/dealer hand and player hand against payoff scale.

It would be desirable to incorporate all three play methodologies in as simple a poker game as possible and allow certain of these methodologies to be played without a house advantage inherent in those methodologies. The simplest type of poker game is showdown. The invention should be applicable to any form of poker but should most easily be applied to a standard three-card hand, a standard five-card hand and a standard seven-card hand, wherein the best five-card hand of the seven cards is utilized.

If the house advantage is applied to the payoff scale wager only, and the player against player and player against dealer wagers are dependent upon the payoff scale wager, then both of the dependent wager modes could be operated without any house advantage.

SUMMARY OF THE INVENTION

The game according to the invention, so-called Showdown Poker, is preferably played in a casino environment using a house dealer. The table is preferably a blackjack style size with a special dedicated cloth layout. One or more decks of standard fifty-two card decks are used with regular established poker rankings attributed to card combinations. Up to seven players and a dealer can be accommodated, with each player having a separate and distinct betting area.

Each player betting area has three individual betting areas, one for each mode of play, respectively. A compulsory mode of play is the mode against a payoff scale. Optional modes of play are a mode of player hand against player hand and player hand against dealer hand. As the optional modes are dependent upon play in the compulsory mode, there may be a numerical relationship between the wagers, which would preferably be an equal amount. The game could alternatively be operated either where one optional bet is compulsory or both optional bets are compulsory. Optional bets may be for any amount from the table minimum to, for example, the amount of the compulsory bet, and the two optional bets may be of similar or different amounts.

After placing bets, dealing hands and showing cards, all bets are resolved. The method of resolution of player hand against dealer hand is to compare the two hands, with the best hand according to the rules winning. If the house hand winds the player loses, but if the player hand wins, the player wins 1 to 1. This mode of play has no house advantage.

The method of resolution of player hand against player hand could include the dealer hand as a participating hand, thereby allowing resolution of this mode even when there is only one player and also where multiple players have placed different wager amounts. The player hand with the lowest wager in this mode is compared with all other player hands. The player with the best hand receives the amount of that wager from each player, including the dealer if the dealer is functioning as a player in this mode. That lowest wager hand is then ignored, and the player hand with the lowest remaining wager is compared and resolved using the same method. This process is repeated until all bets are resolved or until only one player remains. If the dealer functions as a player, then the bet is resolved by the same method as the player against dealer mode, whereas if the dealer does not function as a player, the surplus wager is merely returned to the player. This mode of play also has no house advantage.

The method of resolution of the payoff scale bets involves taking a losing hand wager and paying appropriate winning hand wagers according to a variable payout. Additionally, the payoff scale could include a comparison with the dealer hand, whereby with an inferior hand to the dealer hand, the player wager either loses or pushes. The desired house advantage is embodied in the payoff scale, and as the payoff wager is compulsory, an overall house advantage is effected.

These and other advantages of the present invention are achieved according to exemplary embodiments of the invention, wherein a method of playing a casino game includes the steps of (a) receiving a first wager for a first playing mode, the first playing mode being compulsory; and (b) receiving at least a second wager for at least a second playing mode, wherein the second playing is without a house advantage. The method may further include the step of (c) receiving a third wager for a third playing mode, which is also without a house advantage. In another exemplary embodiment, a method of playing a casino game includes the steps of (a) receiving a first wager for a first playing mode, (b) receiving a second wager for a second playing mode, and (c) receiving a third wager for a third playing mode, wherein the second and third playing modes are without a house advantage. In accordance with still other exemplary embodiments of the invention, an apparatus configured for playing a casino game includes a display, a player interface for receiving player input, and a processor configured to effect game play, wherein the processor enables the method according to the present invention.

BRIEF DESCRIPTION OF THE DRAWINGS

These and other aspects and advantages of the present invention will be described in detail with reference to the accompanying drawings, in which.

DETAILED DESCRIPTION OF PREFERRED EMBODIMENTS

Figure 1:
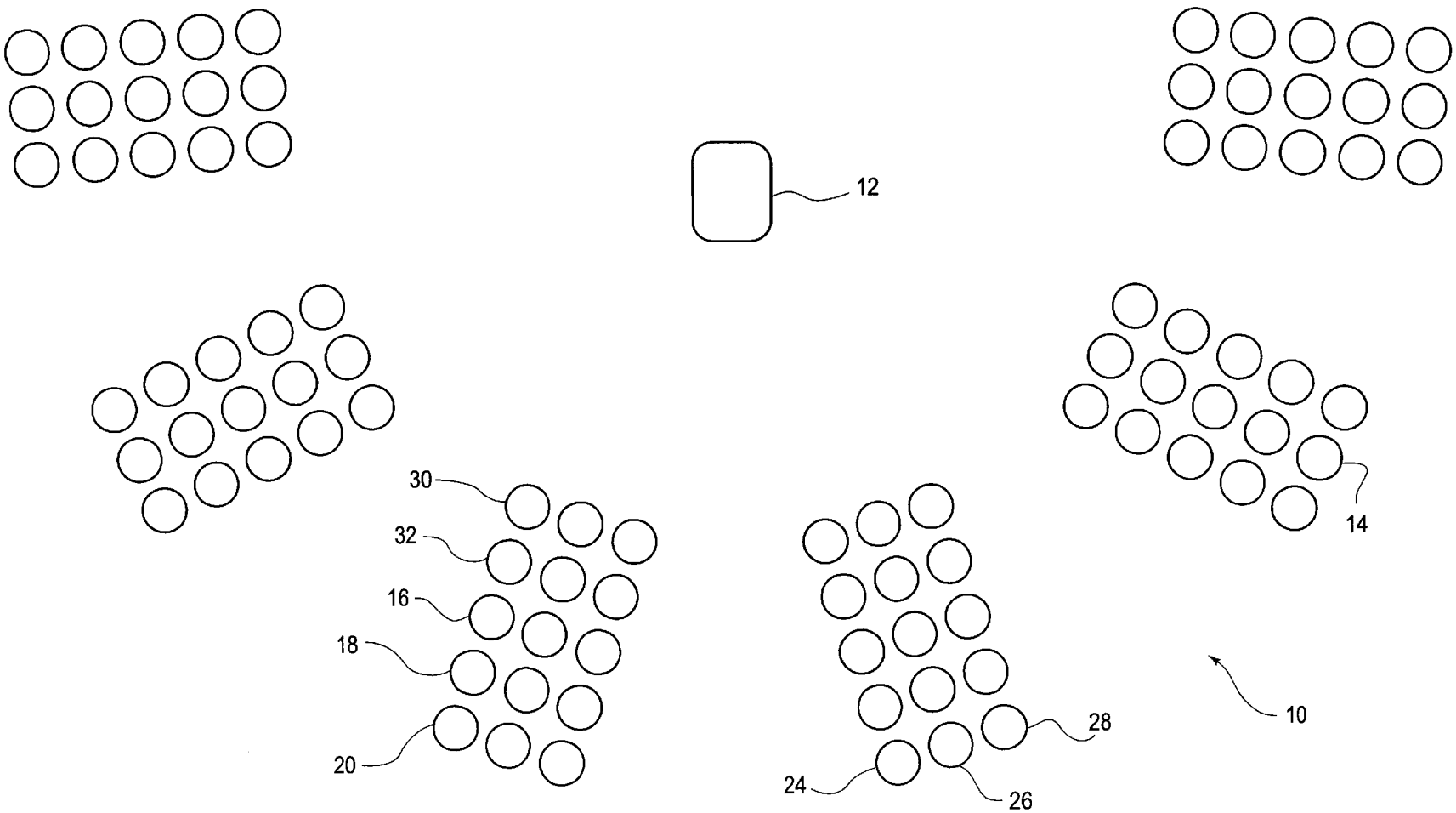
FIG. 1 is a plan view of the table layout according to the present invention.

FIG. 1 is a plan view of an exemplary layout 10 for the game according to the present invention. The layout 10 includes a dealer area 12 and a plurality of betting areas 14. Preferably, up to seven players can participate in the game at a time.

Each player betting area 14 includes three wager options for three different playing modes plus two side bet options for each version, totaling fifteen player wager options. The desired mode of play and selected wagering option is indicated by the player's wager placement. The player betting areas 14 each include a payout mode wager area 16, an "against dealer" wager area 18, and an "against player" wager area 20. Rules and payoffs are shown, for example, between the player betting areas 14 at areas 22.

Each of the playing modes can preferably be played as a three-card game, a five-card game or a seven-card game. The player betting areas 14 thus also include for each playing mode a three-card wager area 24, a five-card wager area 26, and a seven-card wager area 28. Two side bet wager areas 30, 32 are also provided for each card multiple option. Of course, the game may be played with fewer or greater options, and the invention is not meant to be limited to the illustrated example.

Preferably, a single standard fifty-two card deck of playing cards is used using conventional poker combinations. In alternative arrangements, multi-deck playing modes could be contemplated, and other means for determining hand ranks could be used, such as numerical totals with a blackjack or baccarat count system. Still other alternatives could utilize dice with poker values or numerical values applying.

Players place wagers according to game rules and preferably with a compulsory wager at payout mode wager area 16 for any of the card number options (24, 26, 28). The card number options at 24, 26 and 28 may be fixed according to playing modes (e.g., three-card wager at 16 only, five-card wager at 18 only, seven-card wager at 20 only) or by player choice or mixed variations. Wagers for the "against dealer" mode at 18 and the "against player" mode at 20 are optional and in a preferred embodiment, may be placed only for card number modes matching the card number mode of the payoff mode wager at 16. Moreover, it is preferable to limit the optional wagers at 18 and 20 to a multiple of the compulsory wager at 16, such as a multiple of 1 (i.e., equal amounts).

Three cards are dealt to each player area 14 and the dealer area 12. Subsequently, three-card wagers at 24 with wagers at 16/24 are paid according to a payout scale by comparing the player three-card hands with hand ranks set forth on the payout scale; three-card wagers at 18/24 are either taken or paid 1 to 1 based on a comparison of the player three-card hand rank with the dealer three-card hand rank; and winning hands at wager area 20/24 are paid by each player for an amount equal to the amount wagered by the player(s) with the winning hands. In one embodiment, the dealer may also be considered a player for wagers at area 20 so that this mode of play can still be used in the event of a single player game.

In the event of a tied hand for wagers at 18/24, the wagers are pushed, and in case of tied hands for wagers at 20/24, preferably, tied hands split winnings. Odd chips are distributed according to an accepted formula, such as either first hand to the left of a rotating deal assignation, or suit order ranking of the highest card. For example, the scale of clubs, diamonds, hearts, spades could apply whereby if the highest card in each tied hand was an Ace, then the Ace of clubs would be regarded as the winner of the odd chips; and if the Ace of clubs was not in the hands, then the Ace of diamonds would be regarded as the winner, and so on.

Each player and the dealer then receive two additional cards, totaling five cards. Wagers at 16/26, 18/26 and 20/26 are then resolved in the same manner as described above. Finally, in this embodiment, each player and the dealer then receive two additional cards, making a seven-card hand from each of which a five-card hand is selected, and wagers at 16/28, 18/28 and 20/28 are resolved. Alternative versions of the subject game could incorporate only one or two of the required number of cards to constitute a hand. Further, yet another alternative could incorporate only the compulsory mode, or the compulsory mode and only one of the optional modes. One or both of the wagers at 18 and 20 may also be made compulsory.

Resolving the payout mode wager at area 16 is preferably done irrespective of the dealer hand. In alternative embodiments, the player hand must also be of a higher rank than the dealer hand to be paid the ranking odds, and in the event that the player's hand rank is lower than the dealer's hand rank, the wager at area 16 may be pushed or taken according to game rules.

With continued reference to FIG. 1, the game according to the invention may also include one or more side wagers, for example at areas 30 and 32, respectively. As shown, each side bet 30, 32 is applicable to each card number mode of play (24, 26, 28). In a preferred embodiment, a first side bet at area 30 is a fixed amount wager (such as $1) that only wins on a Straight Flush for the five-card version. The payout is preferably a fixed amount, such as $50,000 for a fixed $1 wager. A second side bet at area 32 is a fixed payoff on a spread of hands with a variable wager amount. For example, with the five-card version, the payoff could be for a pat hand, meaning a Straight or better, and could be as high as 125 to 1. Since the two side bets at areas 30 and 32 are of a different nature, the bets could be played simultaneously. Naturally, the same principles could apply to three- and seven-card versions as shown. Preferably, participation in the base game including a compulsory bet at wager area 16 is a prerequisite to enable participation in the side bet wagers 30, 32.

As would be apparent to those skilled in the relevant art, the invention can be embodied in a wide variety and forms of media such as, but not limited to, single player slot video machines, multi-player slot vide machines, electronic games and devices, lottery terminals, scratch-card formats, software, as well as in-flight, home and Internet entertainment. In addition, the invention can be readily implemented as a computer program product (e.g., floppy disk, compact disc, etc.) comprising a computer readable medium having control logic recorded therein to implement the features of the invention as described. Control logic can be loaded into the memory of a computer and executed by a central processing unit (CPU) to perform the operations described herein.

Figure 2:
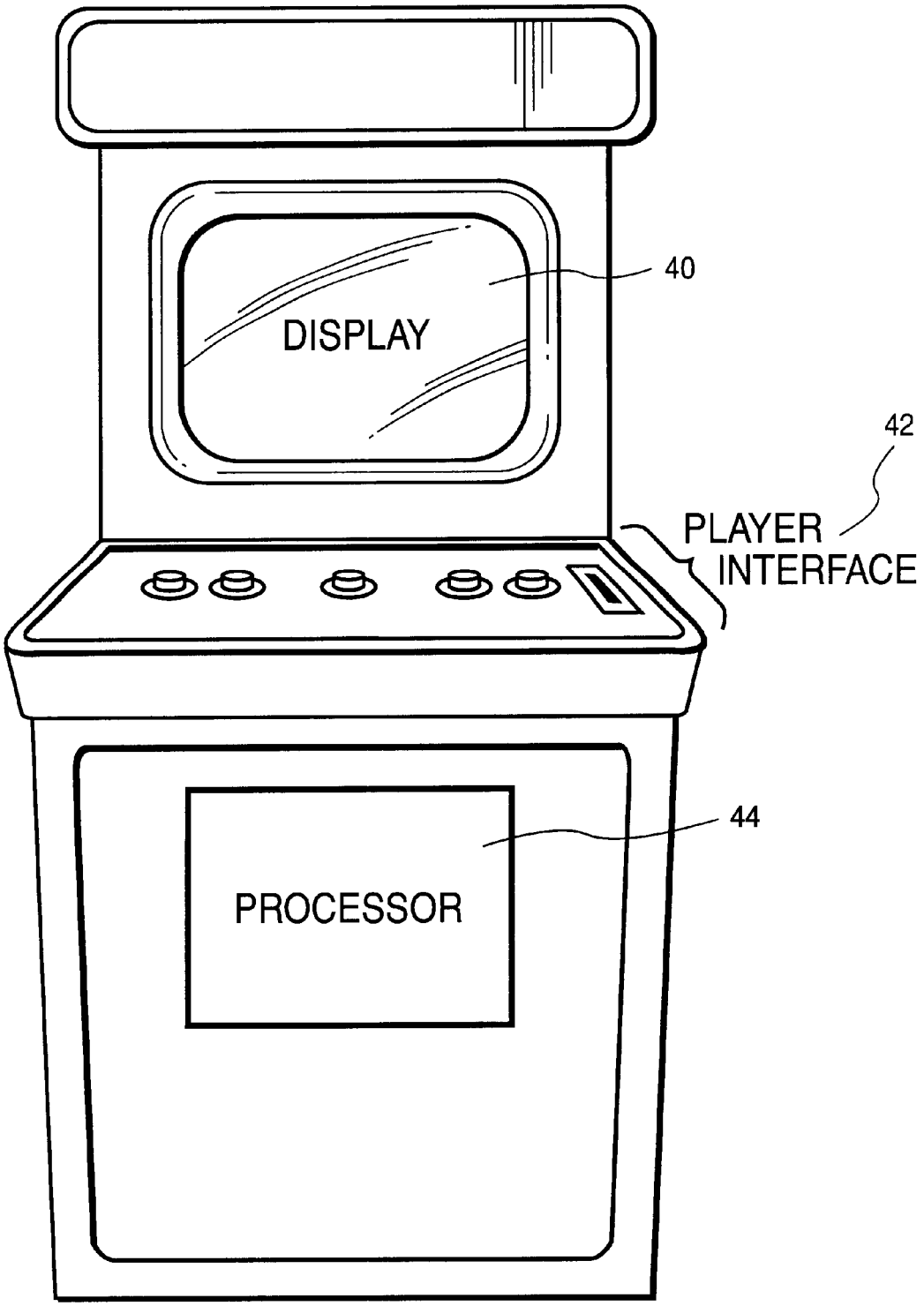
FIG. 2 is a block diagram illustrating the structure effecting game play according to the apparatus of the present invention.

In this context, referring to FIG. 2, a block diagram is illustrated showing the components of an apparatus configured for playing the game according to the invention. The apparatus includes a display 40, a player interface 42, and circuitry 44 for effecting game play and including structure for receiving wagers in one or more playing modes and dealing hands according to the rules of the game. The processing circuit 44 effects game play according to game rules and resolves wagers based on a comparison of player hand to the payout scale, player hand to dealer hand, and player hand to player hand, respectively.

With the game according to the present invention, three play methodologies utilizing a poker game desirably enables certain of the methodologies to be played without a house advantage. A plurality of options enable the players to play "customized" versions of the game against a payout scale, the dealer and/or other players. The game also provides one or more side wager options that enhance player interest by providing a chance for a high payout.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A method of playing a casino game, comprising:

(a) receiving a first wager for a first playing mode, the first playing mode being compulsory;

(b) receiving at least a second wager for at least a second playing mode, wherein the second playing mode is without a house advantage;

(c) dealing hands of playing cards to a dealer and to at least one player, and resolving the first wager according to a poker rank of the player hand against a payout scale; and (d) resolving the second wager without a house advantage according to a poker rank of the player hand against one of (1) a poker rank of the dealer hand, and (2) a poker rank of another player hand.

2. A method according to claim 1, further comprising (e) receiving a third wager for a third playing mode, wherein the third playing mode is without a house advantage.

3. A method according to claim 2, wherein the second wager and the third wager are optional.

4. A method according to claim 2, wherein one of the second wager and the third wager is compulsory.

5. A method according to claim 2, wherein both the second wager and the third wager are compulsory.

6. A method according to claim 2, wherein steps (a), (b) and (e) are practiced by requiring each of the first, second and third wagers to be equal.

7. A method according to claim 2, wherein steps (b) and (e) are practiced by permitting the second and third wagers to be any amount up to the first wager.

8. A method according to claim 2, wherein steps (b) and (e) are practiced by permitting the second and third wagers to be any amount up to a multiple of the first wager.

9. A method according to claim 1, further comprising (e) receiving a third wager for a third playing mode, wherein the third playing mode is without a house advantage, and further comprising resolving the third wager according to the poker rank of the player hand against the other of (1) the poker rank of the dealer hand, and (2) the poker rank of the another player hand.

10. A method according to claim 9, wherein the one of the second and third wagers that is resolved against the poker rank of the another player hand is resolved by comparing the player hand with a smallest associated wager with the another player hand, and paying a winning amount corresponding to the smallest associated wager from each corresponding player wager to a winning player, and repeating the comparing step according to a next smallest associated wager until all bets are resolved.

11. A method according to claim 10, further comprising regarding the dealer hand as a player hand for resolving the one of the second and third wagers that is resolved against the poker rank of the another player hand.

12. A method according to claim 9, wherein the one of the second and third wagers that is resolved against the poker rank of the dealer hand is resolved by paying a winning wager 1 to 1, taking a losing wager, and pushing tied hands.

13. A method according to claim 1, wherein the step of resolving the first wager is practiced by resolving the first wager irrespective of the dealer hand.

14. A method according to claim 1, wherein the step of resolving the first wager is practiced by paying a payout according to the player hand poker rank against a payout scale only if the player hand is better than the dealer hand.

15. A method according to claim 14, wherein the resolving step is further practiced by pushing the first wager if the player hand is tied with the dealer hand or if the player hand is inferior to the dealer hand.

16. A method according to claim 14, wherein the resolving step is further practiced by pushing the first wager if the player hand is tied with the dealer hand and taking the first wager if the player hand is inferior to the dealer hand.

17. A method according to claim 1, further comprising, prior to the dealing step, receiving a first side wager that the player hand will be a first predetermined poker rank.

18. A method according to claim 17, wherein the predetermined poker rank is a straight flush.

19. A method according to claim 17, further comprising, prior to the dealing step, receiving a second side wager that the player hand will be at least a second predetermined poker rank.

20. A method according to claim 19, wherein the second predetermined poker rank is a straight.

21. A method according to claim 20, wherein the first side wager is a fixed amount wager, wherein the second side wager is a variable amount wager, and wherein payouts for the first side wager and the second side wager are fixed.

22. A method of playing a casino game, comprising:

(a) receiving a first wager for a first playing mode;

(b) receiving a second wager for a second playing mode;

(c) receiving a third wager for a third playing mode, wherein the second and third playing modes are without a house advantage;

(d) dealing hands of playing cards to a dealer and to at least one player, and resolving the first wager according to a poker rank of the player hand against a payout scale; and (e) resolving the second wager without a house advantage according to a poker rank of the player hand against one of (1) a poker rank of the dealer hand, and (2) a poker rank of another player hand.

23. A method according to claim 22, wherein one of the second and third playing modes is against a dealer and the other of the second and third playing modes is between players against each other.

24. A method according to claim 22, wherein the first wager is compulsory.

25. A method according to claim 24, wherein the second wager and the third wager are optional.

26. A method according to claim 24, wherein one of the second wager and the third wager is compulsory.

27. A method according to claim 24, wherein both the second wager and the third wager are compulsory.

28. A method according to claim 22, further comprising resolving the third wager according to the poker rank of the player hand against the other of (1) the poker rank of the dealer hand, and (2) the poker rank of the another player hand.

29. A method according to claim 22, wherein the dealing step comprises dealing one of three-card, five-card and seven-card hands of playing cards.

30. An apparatus configured for playing a casino game comprising a display, a player interface for receiving player input, and a processor configured to effect game play, the processor enabling:

(a) receiving a first wager for a first playing mode, the first playing mode being compulsory;

(b) receiving at least a second wager for at least a second playing mode, wherein the second playing mode is without a house advantage;

(c) dealing hands of playing cards to a dealer and to at least one player, and resolving the first wager according to a poker rank of the player hand against a payout scale; and (d) resolving the second wager without a house advantage according to a poker rank of the player hand against one of (1) a poker rank of the dealer hand, and (2) a poker rank of another player hand.

31. An apparatus for playing a casino game comprising:

means for receiving a first wager for a first playing mode, the first playing mode being compulsory;

means for receiving at least a second wager for at least a second playing mode, wherein the second playing mode is without a house advantage;

means for dealing hands of playing cards to a dealer and to at least one player, and resolving the first wager according to a poker rank of the player hand against a payout scale; and means for resolving the second wager without a house advantage according to a poker rank of the player hand against one of (1) a poker rank of the dealer hand, and (2) a poker rank of another player hand.

32. A method of playing a casino game, comprising:

(a) receiving a first wager for a first playing mode, the first playing mode being compulsory;

(b) receiving at least a second wager for at least a second playing mode, wherein the second playing mode is without a house advantage;

(c) playing the first and the at least second playing modes;

(d) dealing hands of playing cards to a dealer and to at least one player, and resolving the first wager according to a poker rank of the player hand against a payout scale;

(e) resolving the second wager without a house advantage according to a poker rank of the player hand against one of (1) a poker rank of the dealer hand, and (2) a poker rank of another player hand; and (f) resolving the first wager and the at least second wager according to rules of the casino game, wherein 100% of winnings on the at least second wager are paid to a winning player.

* * * * *